US008465016B2

(12) United States Patent
Winburne et al.

(10) Patent No.: US 8,465,016 B2
(45) Date of Patent: Jun. 18, 2013

(54) MEDIA STACK COMPRESSION WITH PADDLE

(75) Inventors: Robert Lawrence Winburne, Vancouver, WA (US); Kieran B Kelly, Vancouver, WA (US); Keith Jariabka, Portland, OR (US); Juan D Ramos, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 299 days.

(21) Appl. No.: 13/006,536

(22) Filed: Jan. 14, 2011

(65) Prior Publication Data

US 2012/0181745 A1 Jul. 19, 2012

(51) Int. Cl.
*B65H 3/06* (2006.01)

(52) U.S. Cl.
CPC ..... *B65H 3/0684* (2013.01)
USPC ..... 271/117; 271/167

(58) Field of Classification Search
USPC ..... 271/38, 117, 124, 167, 245
See application file for complete search history.

(56) References Cited

U.S. PATENT DOCUMENTS

| | | | | |
|---|---|---|---|---|
| 6,199,855 | B1 * | 3/2001 | Choeng et al. | 271/245 |
| 6,257,569 | B1 | 7/2001 | Rhodes et al. | |
| 6,382,621 | B1 * | 5/2002 | Inoue et al. | 271/167 |
| 6,988,722 | B2 | 1/2006 | Su | |
| 7,104,539 | B2 * | 9/2006 | Shimoyama | 271/167 |
| 7,748,699 | B2 * | 7/2010 | Nakashima | 271/167 |
| 7,758,041 | B2 * | 7/2010 | Okuno et al. | 271/147 |
| 2002/0175462 | A1 * | 11/2002 | Sonoda et al. | 271/121 |
| 2005/0018215 | A1 | 1/2005 | Ruhe et al. | |
| 2005/0129441 | A1 * | 6/2005 | Hirabayashi | 399/405 |
| 2007/0007711 | A1 * | 1/2007 | Suzuki et al. | 271/121 |
| 2008/0179814 | A1 | 7/2008 | Sherman et al. | |

FOREIGN PATENT DOCUMENTS

JP 2005200141 A * 7/2005

* cited by examiner

*Primary Examiner* — Gerald McClain
(74) *Attorney, Agent, or Firm* — Robert McDowell

(57) ABSTRACT

Embodiments provide methods, apparatuses, and systems for compressing media in a media stack. In various embodiments, a paddle moves between various positions. During the move, the paddle is configured to compress the media stack.

11 Claims, 9 Drawing Sheets

MEDIA STACK COMPRESSION WITH PADDLE

BACKGROUND

Picking a sheet of media for a print job is typically accomplished by a mechanism that utilizes a pick roller to move the sheet of media from an input tray toward a print zone. To prevent multiple sheets of media from moving together, a separation system may be employed to retard any sheets of media beyond the top sheet from advancing more than a slight distance. Continuous pick cycles, however, may cause those slight distances to accumulate throughout the media stack. These variances may result in the simultaneous loading of multiple sheets.

DETAILED DESCRIPTION

In printing systems, various print paths may be utilized to deliver media to a print module and ultimately to an output tray. For example, a printing system may utilize a "top-in, front-out" path where media is loaded into a substantially upright media tray feeding into a top face of the system, and output the processed media through the front face of the system. Alternatively, a printing system may utilize a "front-in, front-out" path where media is loaded into a substantially horizontal media tray feeding into the front face of the system. The media is pulled in through the front face, processed, and output through the front face of the printing system, either above or below the horizontal media tray. Both systems generally rely on the ability to draw or "pick" individual sheets of media.

In various embodiments, methods, apparatuses, and systems for improving pick reliability and media loading in media stacks, such as upright media stacks, are provided. To improve pick reliability in printing systems utilizing a top-in, front-out path, the printing system may gather and compress the media stack during each pick cycle. By gathering and compressing the media in the media stack during each pick cycle, the media is presented in a predictable manner for picking.

Additionally, to improve loading reliability in printing systems utilizing a top-in, front-out path, the printing system may lift the picking mechanism during a load phase. By lifting the picking mechanism during the load phase, media, for example a single sheet of paper, may be loaded in an efficient manner.

Throughout this disclosure, reference is made to a printing system having an upright or vertical media stack. These terms are merely used for ease of understanding. The disclosure may be applied to systems other than printing systems, and to media stacks oriented in a plurality of manners. The disclosure also refers to media. Media includes any article capable of being processed by printing systems such as, but not limited to, paper of various shapes, sizes, and textures.

Figures 1A, 1B, 1C:
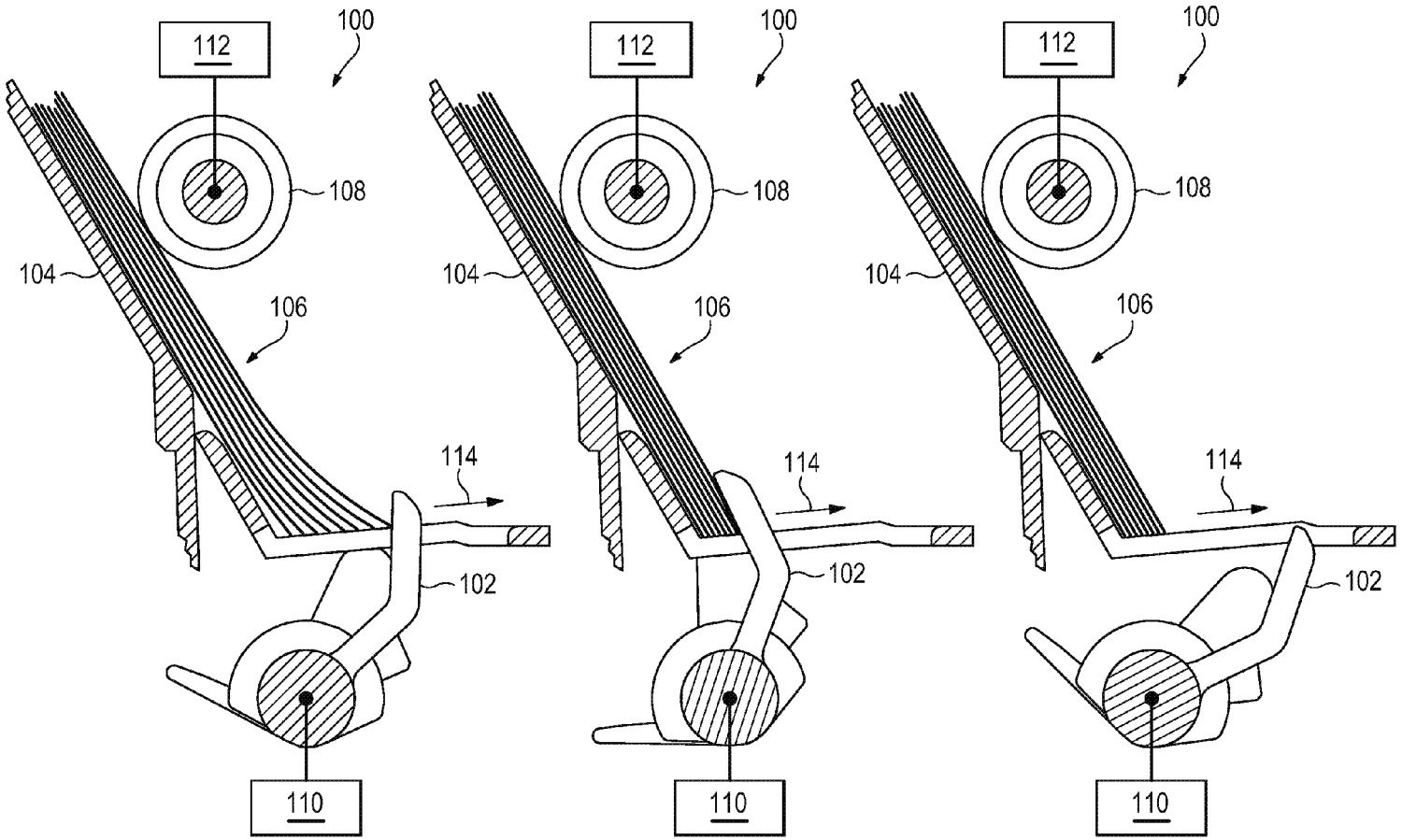
FIG. 1A-C illustrate a media compression system in accordance with various embodiments.

FIGS. 1A-C schematically illustrate a media compression system 100 according to an example embodiment. Media compression system 100 is configured to compress and organize a media stack. FIG. 1A illustrates system 100 in a first state such as a disorganized state. FIG. 1B illustrates system 100 in a second state such as a compression state. FIG. 1C illustrates system 100 in a third state such as a retracted state.

In the illustrated embodiment, system 100 includes a paddle 102, a media tray 104, a media stack 106, a pick mechanism 108, a first assembly 110, and a second assembly 112. In the embodiment, the media tray 104 is an upright media tray having an incline or slope. In other embodiments, the media tray 104 may be horizontal or include various other slopes. The media stack 106 includes media such as, but not limited to, paper.

The paddle 102 may be a load limiting mechanism configured to limit an amount of media loaded into the system 100. In various embodiments, the paddle 102 may include a central axle on which multiple paddles are positioned. The pick mechanism 108 may include one or more elements configured to pick or select media in the media stack 106. The pick mechanism 108 may feed or move the media along media path 114. In various embodiments, the pick mechanism 108 may include one or more picking tires.

The first assembly 110 may coupled to the paddle 102 and a feedshaft (not illustrated). The first assembly 110 may be configured to move the paddle 102 between a plurality of positions. For example, the first assembly 110 may be configured to move the paddle 102 between a first position wherein the paddle compresses the media stack 106 and a second position where the paddle 102 out of the media path 114 of the media stack 106. Although not illustrated, in various embodiments, the first assembly 110 may also be coupled to the pick mechanism 108 and configured to move the pick mechanism 108 between a plurality of positions. For example, the first assembly 110 may be configured to move the pick mechanism 108 to a lifted position, wherein the pick mechanism 108 is separated from the media stack 106. This may facilitate loading of additional media into media stack 106.

The second assembly 112 may be coupled to the pick mechanism 108, and in various embodiments, the first assembly 110. The second assembly 112 may be configured to actuate the pick mechanism 108 to move media in the media stack 106 through the media path 114. The movement of media through the media path 114 may occur as the first assembly 110 transitions the paddle 102 from a first position, such as a compression position, to a second position, such as the retracted position. This may enable feeding of the media in an expedient manner.

Referring to FIG. 1A, the system 100 is in a disorganized state. The paddle 102 is positioned in a feed path 114 of the media stack 106. In the disorganized position, the paddle 102 may be in a load position where the paddle serves to limit the amount of media that may be loaded into the media stack 106.

In FIG. 1B, the paddle has been actuated by the first assembly 110 to compress the media stack 106. Consequently, the paddle 102 has been moved to a compression position. In the compression position, the paddle 102 remains in the media path 114 of the media stack 106. The compression serves to organize the media stack 106.

After arriving at the compression position, the first assembly 110 may move the paddle to a retracted position, as illustrated in FIG. 1C. In the retracted position, the paddle 102 is moved outside of the media path 114 of the media stack 106, thereby allowing the media to move through the media path 114. In various embodiments, the second assembly 112 may actuate the pick mechanism 108 to pick or select media in the media stack 106 as the first assembly 110 moves the paddle 102 from the compression position to the retracted position. With the media stack 106 in an organized manner, the pick mechanism 108 may more accurately pick media.

Figure 2:
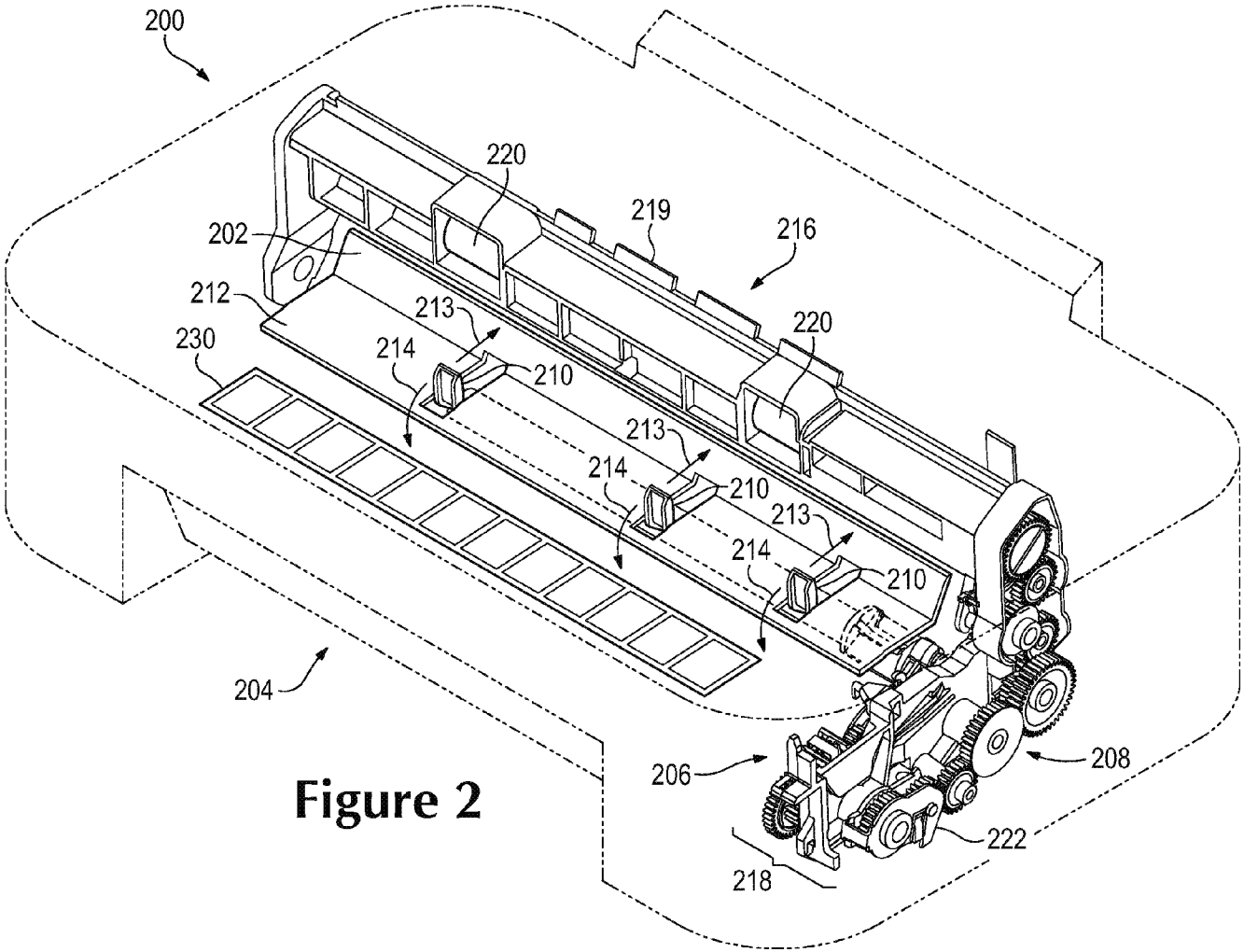
FIG. 2 illustrates a printing system in accordance with various embodiments.

Referring to FIG. 2, a printing system 200 is illustrated in accordance with an example of the present disclosure. The illustrated printing system 200 is an example of a "top-in, front-out" printer. Media, such as paper, is loaded in a vertical media tray 202 and fed through the printing module 230 prior to being output through the front face 204 of the printing system 200. Among other things, the printing system 200 includes a first assembly 206, a second assembly 208, a paddle 210, vertical or upright media tray 202 for supporting a media stack (not illustrated), and picking mechanism 216 including pick arm 219 and pick tires 220. In various embodiments, the media stack is defined as an amount of media disposed within the media tray 202.

In the example embodiment, the printing system 200 includes one or more paddles 210 disposed along a length of the printing system 200. The paddles 210 may be disposed on a single axle, and consequently, are configured to move in a synchronized manner. In the figure, three paddles 210 are illustrated; however, more or fewer paddles may be utilized without deviating from the scope of the disclosure.

The paddle 210 is configured to transition between a plurality of positions. Such as a load position, a compression position, and a retracted position. In the load position, as illustrated in FIG. 2, a user may load media into the media tray 202. In the load position, the paddle 210 may function to prevent media from progressing into the printing path or the print module. In addition, the paddle 210 may also function to prevent a user from loading too much media into the media tray 202, thereby overloading the system 200.

In a second position, for example, a compression position, the paddles 210 have moved toward the media stack or the media tray 202 to compress the media stack. The compression position may change dependent upon, for example, an amount of media in the media stack. For example, a compression position for a fully loaded media stack may be different than a compression position for a media stack with less than a full amount of media. The paddle 210 may arrive at the second position, for example, by rotating toward the media tray 202 as indicated by arrows 113.

In a third position, for example a retracted position, the paddles 210 are moved out of the print path, thereby allowing a picked media to enter the print module 230. The paddles 210 may arrive at the third position by rotating away from the media within the media tray 202, for example, by rotating under plate 212 as indicated by arrows 214.

In various embodiments, as the paddles 210 may arrive at the compression position during a transition from the load position to the retracted position. For example, in transitioning from the load position to the retracted position, the paddles 210 may be configured to rotate toward the media the media tray 202 before moving to the retracted position 214. This movement 213 toward the media tray 202 may serve to gather and compress the media stack.

The first assembly 206 may be disposed on one side of a gearing assembly 218 while the second assembly 208 is disposed on an opposing side of gearing assembly 218. The first assembly 206 includes a plurality of gears and swing arms as will be discussed in more detail herein. In various embodiments, the first assembly 206 is configured to actuate the paddles 210.

Actuation of the paddles 210 may include movement of the paddles 210 between the load position, the compression position, and the retracted position. The first assembly 206 may be configured to actuate the paddles 210 to compress media in the media stack during a transition of the paddles 210 from a load position to a retracted position. The compression of the media may be in response to rotation of a feedshaft (not illustrated) in a first direction. Additionally, the first assembly 206 may be configured to move the paddles 210 from the retracted position to the load position in response to rotation of the feedshaft in a second direction.

In various embodiments, the first assembly 206 may also be configured to move the pick mechanism 216 from a pick position, where the pick mechanism 216 applies a normal force to the media in the media tray 202, to a lifted position, where the pick mechanism 216 is lifted from contact with the media in the media tray 202. The movement of the pick mechanism 216 may be synchronized with the actuation of paddles 210. For example, when the paddles 210 are in a load position, the first assembly 206 may be configured to move the pick mechanism 216 to a lifted position. Alternatively, as the paddles 210 transition to the retracted position, the first assembly 206 may move the pick mechanism 216 to the pick position.

In various embodiments, the system 200 may include a second assembly 208 disposed on a second side of the gearing assembly 218. The second assembly 208 may include a plurality of gears and one or more swing arms 222, as will be discussed in more detail herein. The second assembly 208 is configured to actuate the pick mechanism 216 to pick media from the media stack. In various embodiments, the pick mechanism 216 includes a pick arm 219 and one or more pick tires 220. The second assembly 208 may be configured to rotate the one or more pick tires 220 to pick the media in the media stack.

Figure 3:
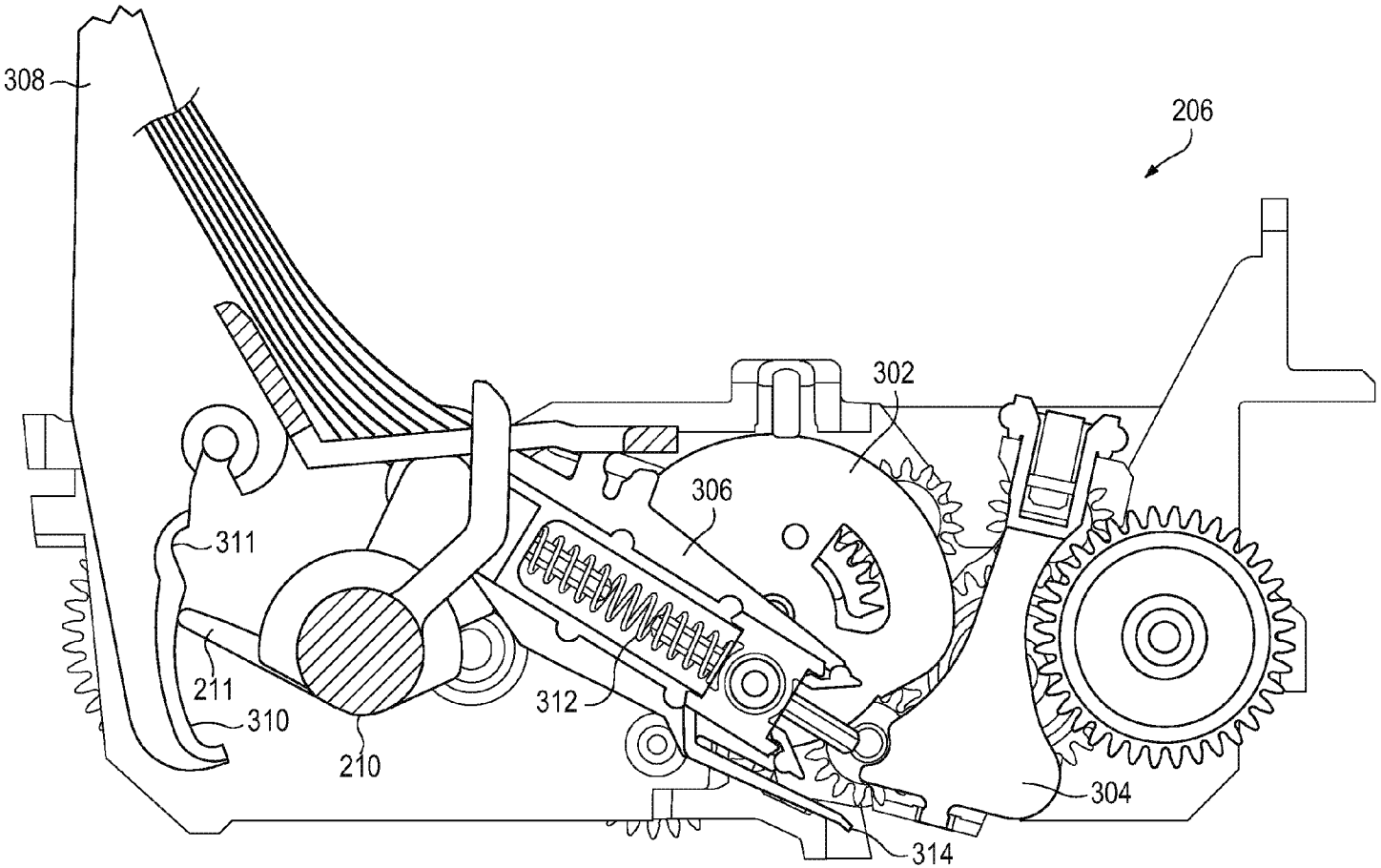
FIG. 3 illustrates a view of a first assembly in accordance with various embodiments.

Referring to FIG. 3, an embodiment of the first assembly 206 is illustrated in accordance with various embodiments. The first assembly 206 includes a cam 302, a loadstop swing arm 304, and a loadstop actuator link 306. In addition, the first assembly 206 may be coupled to a feedshaft (not illustrated) and a plurality of gears configured link various elements within the assembly. The various components of the first assembly 206 will be discussed further with reference to FIGS. 4-7.

Figure 4:
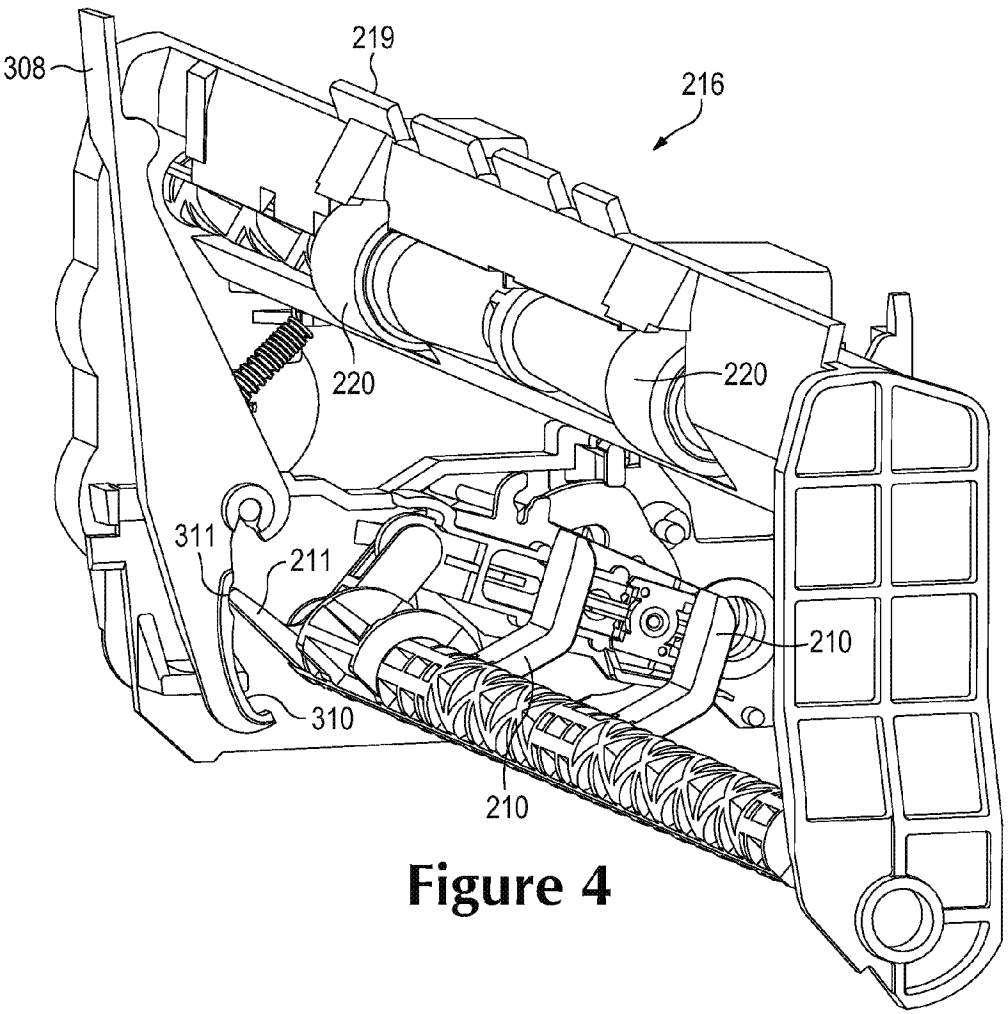
FIGS. 4-7 illustrate a view of various components within the first assembly in accordance with various embodiments.

Referring to FIGS. 3 and 4, the paddles 210 and the pick arm lifter 308 are illustrated in accordance with an embodiment. The paddles 210 may include a lever 211 that actuates a pick arm lifter 308. The pick arm lifter 308 moves the pick mechanism 216 between the pick position and the lifted position. The pick arm lifter 308 includes a crescent shaped engagement area 310 and a recess 311 configured to enable the lever 211 to move the pick arm lifter 308. Because the lever 211 of the paddles 210 actuate the pick arm lifter 308 as it moves between a load position and a retracted position, the pick arm lifter 308 is synchronized with the paddles 210 and actuated by the first assembly 206.

Figure 5:
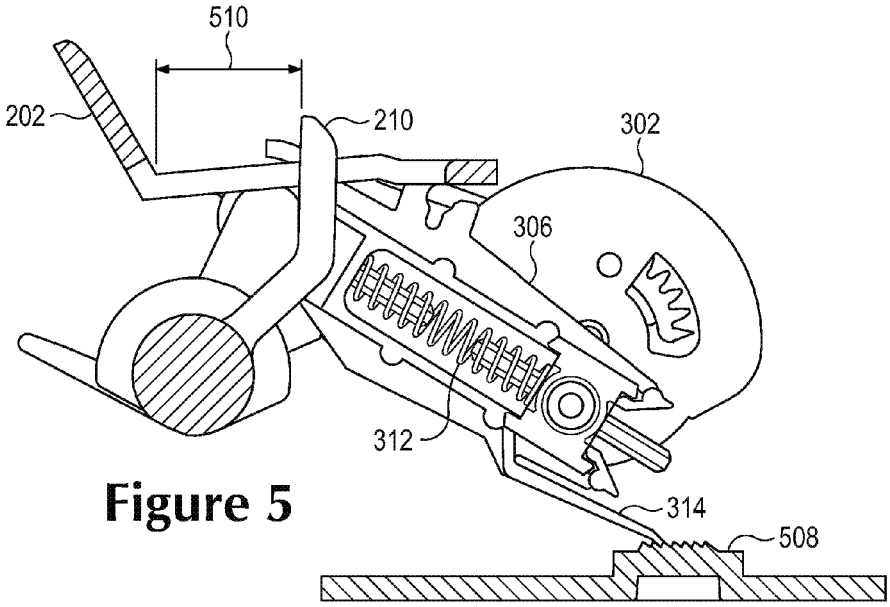
Figure 6:
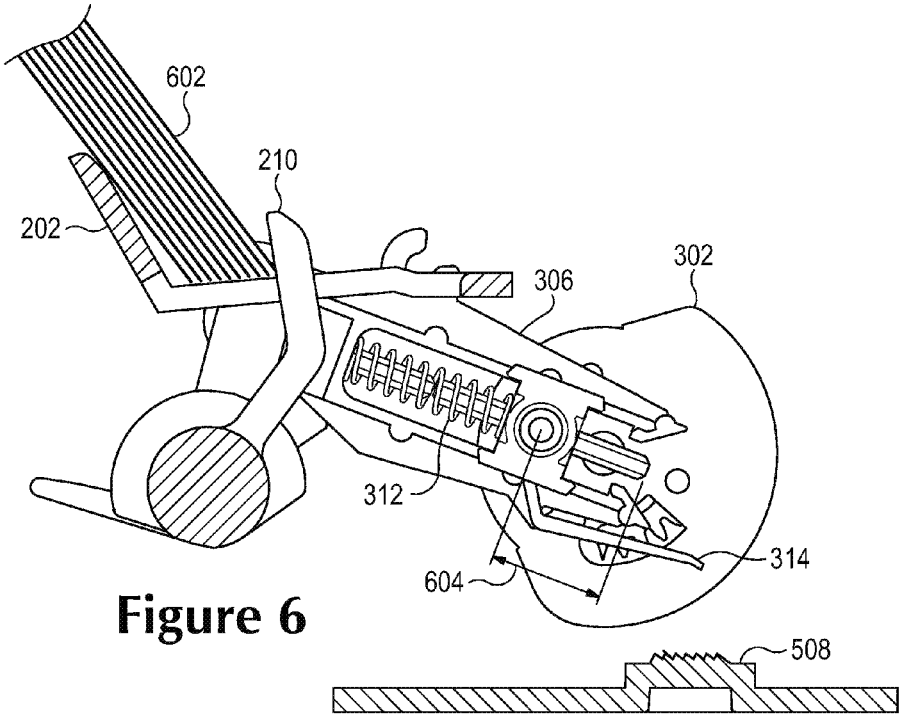

Referring to FIGS. 5 and 6, a view of the cam 302, the actuator link 306, and the paddles 210 of the first assembly 206 are illustrated in accordance with various embodiments. The paddles 210 are coupled to the cam 302 via the actuator link 306. The actuator link 306 includes a spring bias 312 and a latching mechanism 314.

With reference to FIG. 5, the cam 302, the actuator link 306, and the paddles 210 are illustrated in a load position. The paddles 210 determine the maximum amount of media that may be disposed in the media tray 202. For example, the maximum amount of media being limited to an amount that fits within area 510. To prevent media from back-driving the paddles 210, that is, forcibly moving the paddles 210 backward, the actuator link 306 includes a latching mechanism 314. The latching mechanism 314 engages one or more protrusions 508 disposed on, for example, the inside of the housing of the system. As the cam 302 rotates, the latching mechanism 314 of the actuator link 306 may move through one or more of the protrusions 508. In various embodiments, this may prevent back-driving the paddles 210 as they travel through additional movements such as a compression movement.

Referring to FIG. 6, the cam 302, the actuator link 306, and the paddles 210 are illustrated as the paddles 210 compress the media stack 602. As the cam 302 rotates in a clockwise fashion, the paddles 210 are moved toward the media tray 302 to gather and compress the media stack 602. In various embodiments, the media stack 602 in the media tray 302 may include a maximum amount of media or a small amount of media.

To account for the various thickness of the media stack 602, the actuator link 306 includes a spring bias 312. For example, a media stack 602 including a maximum amount of media would prevent movement of the paddles 210 during the compression movement. This lack of movement would impact gearing throughout the first assembly 306. Consequently, the spring bias 312 enables the cam 302 to continue rotating when the paddles 210 are incapable of further movement. As seen in FIG. 6, the spring bias 312 begins to move, as indicated by arrow 604, and adjust for the lack of movement by the paddles 210. The spring bias 312 may be configured to account for various amounts of media in the media stack 602. For example, if a minimum amount of media is located within the media stack 602, the spring bias 312 may not experience any compression as the cam 302 rotates. Alternatively, if a maximum amount of media is located within the media stack 602, the spring bias 312 may experience a maximum amount of compression of the cam 302 rotates.

Figure 7:
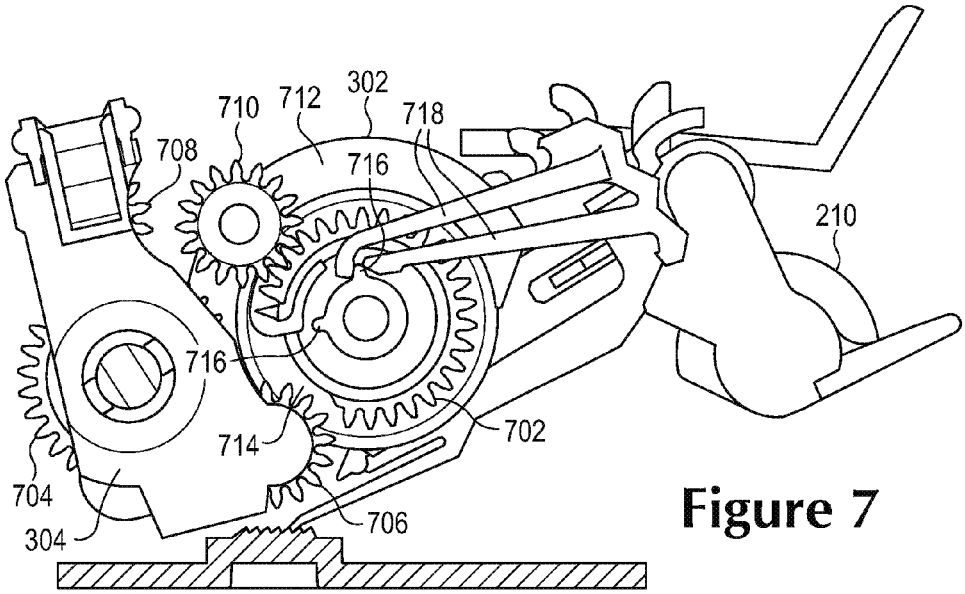

Referring to FIG. 7, a view of the swing arm 304, the cam 302, and the paddles 210 are illustrated in accordance with various embodiments. As discussed, the cam 302 is configured to rotate in a single direction, thereby moving the paddles 210 cyclically through various positions and movements. To maintain the single rotational direction for the cam 302, the first assembly 206 utilizes the swing arm 304.

The swing arm 304 includes a plurality of gears and is configured to swing between a first position and a second position, dependent upon, for example, a rotational direction of the feedshaft (not illustrated). The feedshaft may be driven by a servo and provide the driving force for the first assembly 206. The swing arm 304 is configured to engage the cam 302 with a first plurality of gears 704, 706 while in a first position, for example, while the feedshaft is rotating in a first direction. Upon the feedshaft switching directions, the swing arm 304 may engage the cam 302 with a second plurality of gears 704, 708, 710 while in a second position. In various embodiments, the swing arm 304 may rotate about an arc of approximately fifteen degrees while moving between the first position and the second position.

In the illustrated example, the first plurality of gears and the second plurality of gears of the swing arm 304 may be an even number of gears and an odd number of gears, respectively. Consequently, independent of the rotational direction of the feedshaft, the cam 302 is always rotated in a single direction. In various embodiments, the feedshaft may switch directions based on whether the system is in a pick mode, picking media from a media stack, or a feed mode, feeding media to an output module. As an example, the feedshaft may perform a reverse feed rotation as part of a first mode of operation which includes picking media from the media stack. Once media has entered the media path, the rotation of the feedshaft may change to move the media through a print module, in a second mode of operation.

The cam 302 is coupled to the actuator link 306 and the swing arm 304. The cam 302, in various embodiments, includes a gear 702 configured to engage various other gears within the assembly and a plate 712 coupled to one side of the cam 302. The plate 712 is configured to couple to the actuator link 306 to control or actuate the paddles 210. The cam 302 includes dwell positions that correspond to at least two static positions of the first assembly 206. The two static positions may be associated with a load position of the paddles 210 and a retracted position of the paddles 210. For example, a first dwell position of the plurality of dwell positions is associated with a load position and a second dwell position of the plurality of dwell positions is associated with a retracted position.

In various embodiments the two static positions of the cam 302 are created by the removal of a group of gear teeth 714 from the gear 702 that meshes with the swing arm 304. As the first plurality of gears 704, 706 or the second plurality of gears 704, 708, 710 of swing arm 304 drives the cam gear 302 it will rotate the cam gear 702 until it reaches the area of missing teeth 714. As the last tooth available is rotated by the swing arm 304, the cam 302 is nearing a dwell position. In addition, the cam gear 702 may include a plurality of dents 716 configured to complete the motion of the cam gear 702 into one of the two dwell positions. In various embodiments, the detents 716 more accurately control the cam gear 702 orientation in order to locate the paddles 210 with accuracy and to eliminate noise caused by various teeth of the first assembly 206. The detents 716 may engage one or more detent arms 718 to facilitate the stabilization in the two dwell positions.

Figure 8:
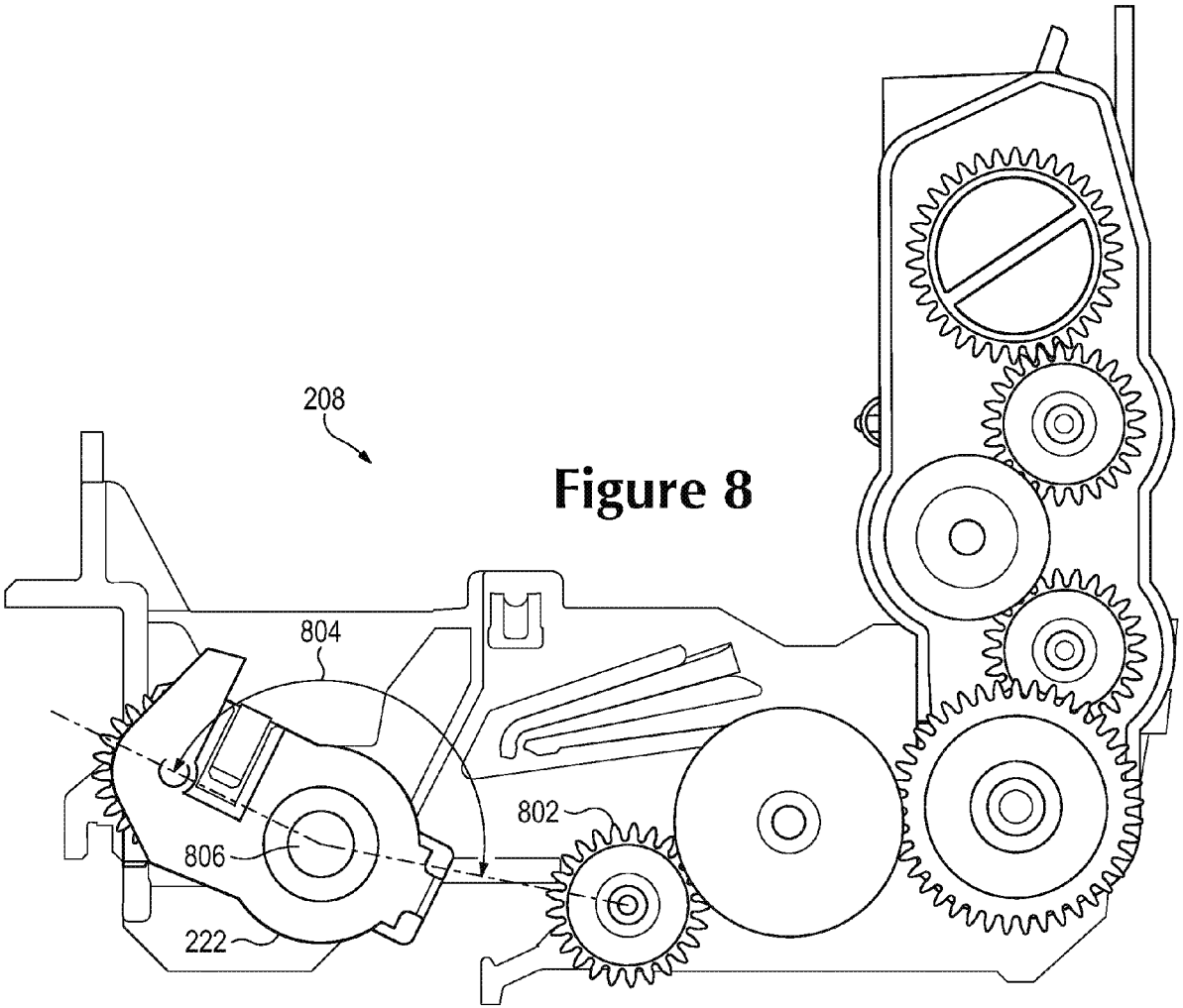
FIG. 8 illustrates a view of a second assembly in accordance with various embodiments.

With reference to FIG. 8, a second assembly 208 is illustrated in accordance with various embodiments. The second assembly 208 includes a pick swing arm 222 and a plurality of gears configured to engage both the pick swing arm 222 and the picking mechanism 216. In various embodiments, the second assembly 208 is coupled to the first assembly 206 by a through-pin 806 that couples the pick swing arm 222 with the swing arm 304.

The pick swing arm 222 is configured to actuate the pick mechanism 216 to pick media in the media stack. The pick swing arm 222 is coupled to the swing arm 304 by a through-pin 806. Consequently, the swing arm 304 and the pick swing arm 222 may be driven by the same source. The source, in various embodiments, may be the feedshaft driven by a servo. The pick swing arm 222 is configured with a delay or a dwell in relation to the swing arm 304. The delay or dwell is manifested in the rotation of the pick swing arm 222 about arc 804 and is determined such that the second assembly 208 actuates the pick mechanism 216 after the first assembly 206 has time to gather and compress the media (arrow 113 of FIG. 1) and begin movement toward the retracted position (arrow 114 of FIG. 1), thereby preventing any unwanted feeding of the media while the paddles 210 are compressing the media stack.

As seen in FIG. 8, the pick swing arm 222 moves about a pivot 806 generating an arc 804. The arc 804, in various embodiments, may be approximately 135 degrees. The length of the pick swing arm 222 is determined such that it engages the gears, for example gear 802 of the second assembly 208, as the paddles 210 move toward the retracted position. As the pick swing arm 222 engages gear 802, the pick swing arm 222 actuates the pick mechanism 216 to pick the media in the media stack.

Figure 9:
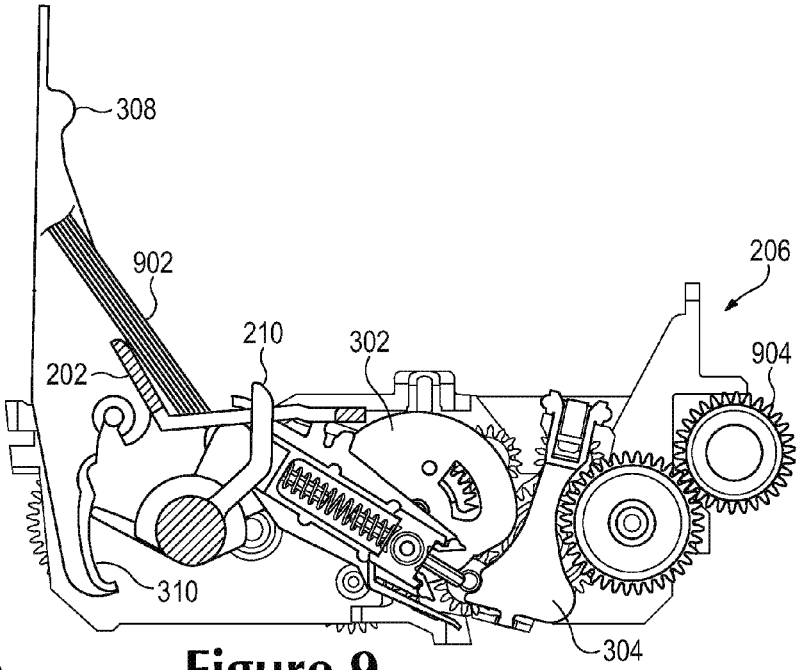
FIGS. 9-11 illustrate various stages of a first assembly in accordance with various embodiments.
Figure 10:
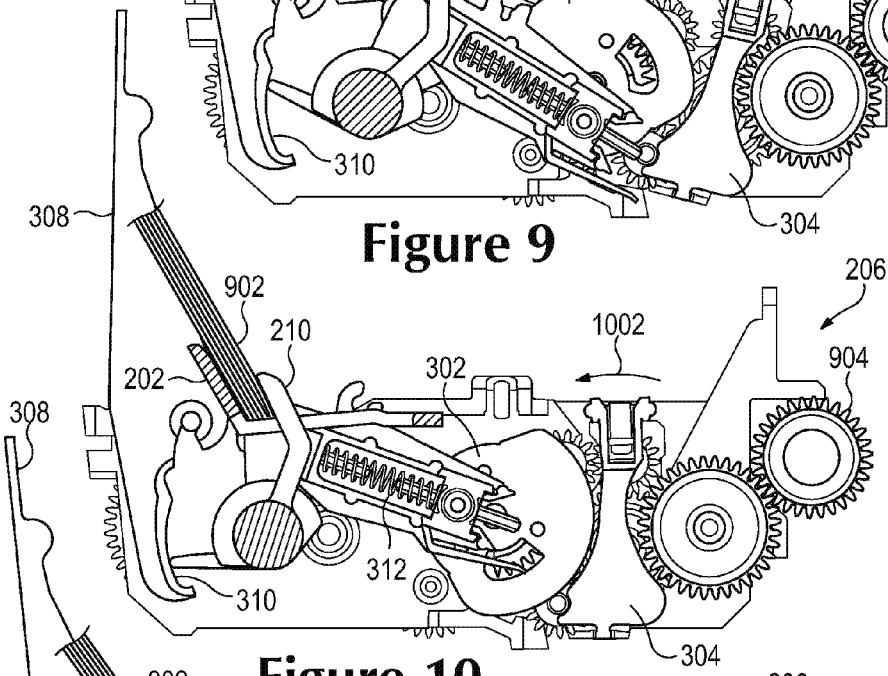
Figure 11:
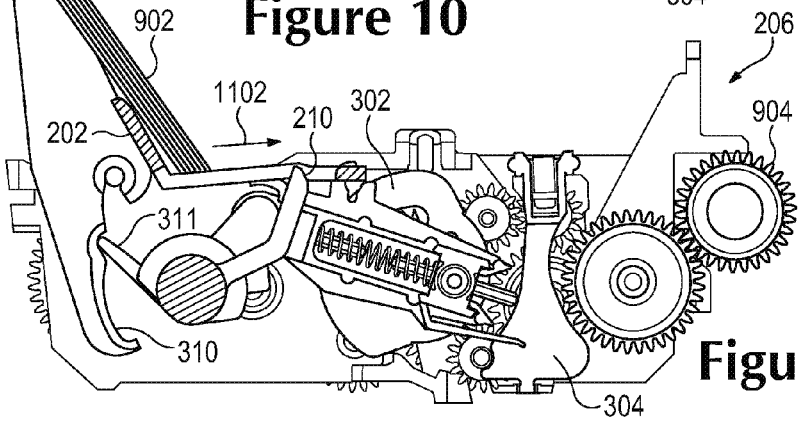

Referring to FIGS. 9-11, various states of the first assembly 206 are illustrated in accordance with various embodiments. In FIG. 9, the first assembly 206 is in a load position. In various embodiments, the load position may be a default or normal position in which the paddles 210 limit the amount of media 902 loaded into the media tray 202. In the load position, the paddles 210 are in the media path of the media stack 902, thereby preventing the media in the media stack 902 from entering printing module (not illustrated). The load position may occur as the feedshaft 902 is rotating in a forward feed direction or when the feedshaft 904 is stationary awaiting a printing action. With the paddles 210 in the load position, the cam 302 is positioned at one of the detents 716 and the swing arm 304 has an associated gear 706 that is currently within the toothless section 714 of the cam gear 702. With the paddles 210 in the load position, the lever 211 is currently engaging the pick arm lifter 308. The lever 211 engages a high point in the crescent 310 which effectively rotates the pick arm lifter 308 toward the pick arm 219 of the picking mechanism 216 and away from the media tray 202, thus lifting the pick arm 219 from the media. The amount of movement of the pick arm 219 can be determined based on the shape of the crescent area 310 of the pick arm lifter 308.

Referring to FIG. 10, the first assembly 206 is shown in a compression position. As the feedshaft 904 begins to rotate in a reverse feed direction, for example, to pick media from the media stack 902, the swing arm 304 rotates 1002 so that second plurality of gears 704, 708, 710 contact the cam 302. The gears of the swing arm 304 then begin rotating the cam 302 in one rotational direction, for example in a clockwise direction. The actuator link 306 begins to move the paddles 210 to compress the media stack 902. In the example where a maximum amount of media is placed in the media tray 202, thus inhibiting full movement of the paddles 210, the spring bias 312 in the actuator link 306 compresses. While not illustrated in FIG. 10, the rotation of the feedshaft 902 in this direction simultaneously begins rotation of the pick swing arm 222 of the second assembly 208 through its arc 804. The arc 804, or dwell, of the pick swing arm 222 enables the paddles 210 to move to the maximum gather or compression position prior to the pick mechanism 216 engaging the media 902.

As the cam 302 continues to rotate through the compression of the media, the paddles 210 move toward the retracted position wherein the paddles 210 are out of the media path 1102. As seen in FIG. 11, as the paddles 210 approach the retracted position the loadstop lever 211 moves into the recess 311 in the pick arm lifter 308. This effectively moves the pick mechanism 216 into a pick position where the pick mechanism is in contact with the media stack 902. While in the pick position, the pick swing arm 222 actuates the pick mechanism 216 and begins to rotate the pick tires 220. Consequently, prior to the paddles 210 reaching the retracted position, but after the compression position, the pick mechanism 216 has been activated and the pick tires 220 to pick media in the media stack 902. Because the paddles 210 have compressed the media stack 902, the media within the media stack 902 may be presented in a consistent and orderly manner.

Still referring to FIG. 11, the first assembly 206 is illustrated in the retracted position. Once the media has been picked by the pick mechanism 216, and the media has made it to a feedshaft 902, the feedshaft 902 may reverse direction and begin to feed the media to the print module and ultimately to the output tray. As the feedshaft 902 begins rotation in an opposite direction, for example a forward feed direction, the swing arm 304 rotates through, for example, 15 degree arc and the first plurality of gears 704, 706 begin to rotate the cam 302 in the clockwise direction. As the cam 302 continues to rotate, the paddles 210 are rotated from the retracted position back to the load position associated with FIG. 9. Movement to the load position may enable a first sheet of media to move into the print path while preventing further sheets of the media stack 902 from similar movement. Once the cam 302 has moved the paddles 210 to the load position the first plurality of gears 704, 706 has reached the gearless portion 714 of the cam gear 702 and the detent 716 again positions the paddles 210 and cam 302 in a static position. In addition to triggering the rotation of the paddles 210 to the load position, the forward feed of the feedshaft 902 also rotates the pick swing arm 222 back to an initial position thus resetting the delay or dwell of the pick swing arm 222 for the next cycle.

Figure 12:
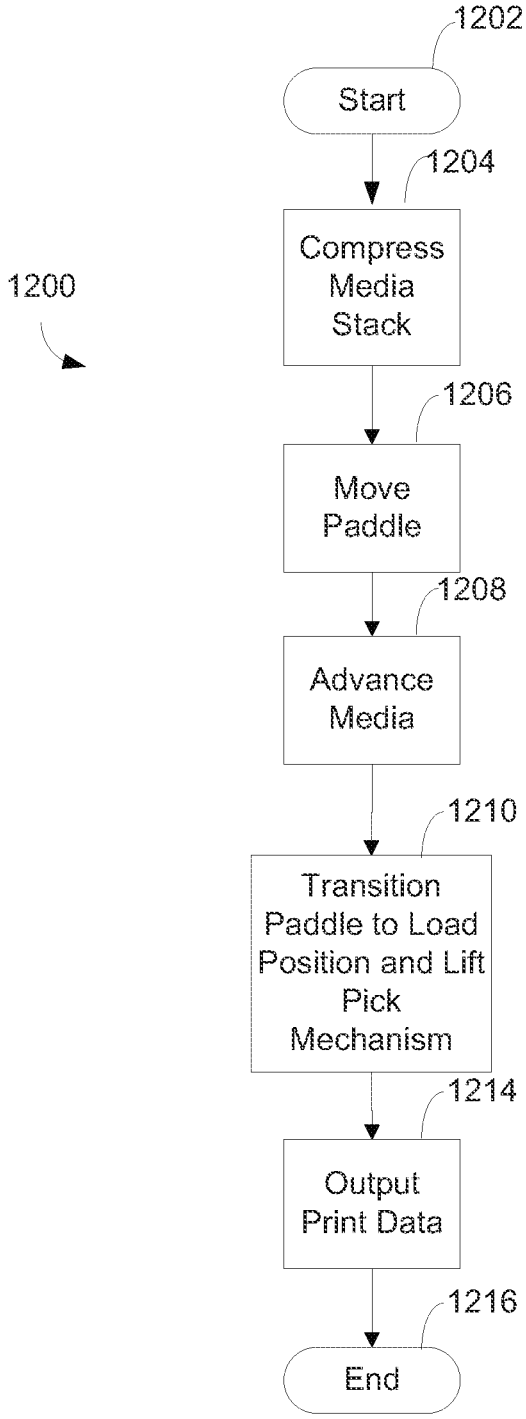
FIG. 12 illustrates a flow diagram in accordance with various embodiments.

Referring to FIG. 12 a flow diagram is illustrated in accordance with various embodiments. The flow diagram may illustrate an embodiment of a method associated with the various systems and apparatuses discussed with reference to FIGS. 1-11. While illustrated a sequence of operations, the flow diagram should not be construed to require that all operations are required for all embodiments, or that the operations are order dependent. Additionally, one or more of the operations may be embodied in the form of computer readable instructions stored on a computer readable medium.

The method 1200 may begin at 1202 where, in at least one embodiment, media may be loaded into a media stack. Proceeding to 1202, a paddle disposed in a media path of the media stack may be moved to a compressing position. In the compressing position, the paddle effectively compresses the media stack to gather and organize the media stack. The paddle may be moved to the compressing position via a first assembly. In at least one embodiment, the first assembly is driven by a servo or other driving mechanism.

At 1206, the paddle may be moved out of the media path of the media stack, for example to a retracted position. The paddle may be moved out of the media path by the first assembly leaving the media stack in the organized manner achieved by the compression. In the retracted position, the paddle may be disposed below a plate utilized to guide the media stack into a printing module.

At 1208, with the paddle disposed out of the media path of the media stack, a pick mechanism may advance media in the media stack into the media path. In various embodiments, the picking mechanism may include a pick arm and a pick tire. Other picking mechanisms are contemplated. Advancing media in the media stack into the media path may be a part of a pick cycle in which a system feeds media to a module, such as a printing module.

At 1210, based on the media advancing into the media path, the paddle may begin transitioning to back to a load position in which the paddle is in the media path of the media stack and limiting an amount of media that may be loaded into the media stack. Transitioning the paddle into the media path of the media stack may prevent additional media from the media stack moving into the media path. In at least one embodiment, as the paddle is transitioning to the load position, the pick mechanism may be disengaged from the media stack. Disengaging the pick mechanism from the media stack may enable further loading of media into the media stack.

At 1214, in an embodiment where the system is a printing system, a printing module may output print data on the media advanced into the media path. The printing module may include any of a number of marking engines, such as but not limited to, an ink jet or a laser jet engine. After output of the print data on the media, the method may end at 1216. In various embodiments, ending at 1216 may include repeating the method 1200.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope of this disclosure. Those with skill in the art will readily appreciate that embodiments may be implemented in a wide variety of ways. This application is intended to cover any adaptations or variations of the embodiments discussed herein. Therefore, it is manifestly intended that embodiments be limited only by the claims and the equivalents thereof.

What is claimed is:

1. An apparatus, comprising:

a paddle configured to limit an amount of media in a media stack;

a first assembly coupled to the paddle, wherein the first assembly is configured to move the paddle between a first position and a second position, wherein the paddle compresses the media stack in the first position and is out of a media path of the media stack in the second position;

a pick mechanism operatively coupled to the first assembly, wherein the pick mechanism is configured to move media in the media stack into the media path; and a pick arm lifter coupled to the first assembly, wherein the pick arm lifter is configured to lift the pick mechanism from the media stack;

wherein the pick mechanism and the paddle compress the media stack on the same surface of the media stack.

2. The apparatus of claim 1, wherein the first assembly comprises a cam including a plurality of dwell positions, at least one of the dwell positions corresponding to the second position.

3. The apparatus of claim 2, wherein the first assembly further comprises a swing arm including a first plurality of gears and a second plurality of gears, the swing arm configured to drive the cam with the first plurality of gears in response to rotation of a feedshaft in a first direction and the second plurality of gears in response to rotation of the feedshaft in a second direction.

4. The apparatus of claim 1, further comprising:

a second assembly coupled to the first assembly, wherein the second assembly includes a swing arm configured to actuate the pick mechanism to move the media in the media stack into the media path.

5. The apparatus of claim 4, wherein the swing arm of the second assembly is configured to actuate the pick mechanism during a transition of the paddle from the first position to the second position.

6. The apparatus of claim 1, further comprising:

a printing module, wherein the printing module is configured to output print data via the media in the media stack.

7. The apparatus of claim 1, wherein the first assembly is further configured to move the paddle from the second position to a load position, wherein the load position is disposed between the first position and the second position.

8. A method, comprising:

limiting, by a paddle, an amount of media insertable into a media stack;

moving, by a first assembly, the paddle from a first position to a second position, wherein the paddle compresses the media stack in the first position and is out of the media path in the second position;

moving, by a pick mechanism, media in the media stack into a media path in response to movement of the paddle; and lifting, by a pick arm lifter, the pick mechanism from the media stack in response to movement of the paddle;

wherein the pick arm lifter coupled to the first assembly, wherein the pick arm lifter is configured to lift the pick mechanism from the media stack;

wherein the pick mechanism and the paddle compress the media stack on the same surface of the media stack.

9. The method of claim 8, further comprising:

moving, by the first assembly, the paddle form the second position to the first position.

10. The method of claim 8, wherein moving the paddle from the first position to the second position comprises moving a cam through a plurality of dwell positions, the dwell positions providing a predetermined delay.

11. The method of claim 8, further comprising:

moving, by the first assembly, the paddle from the second position to a load position, wherein the load position is disposed between the first position and the second position.

* * * * *

UNITED STATES PATENT AND TRADEMARK OFFICE

CERTIFICATE OF CORRECTION

PATENT NO. : 8,465,016 B2
APPLICATION NO. : 13/006536
DATED : June 18, 2013
INVENTOR(S) : Robert Lawrence Winburne et al.

It is certified that error appears in the above-identified patent and that said Letters Patent is hereby corrected as shown below:

In the Claims:

In column 10, line 35, in Claim 9, delete “form” and insert -- from --, therefor.

Signed and Sealed this
Third Day of September, 2013

Teresa Stanek Rea
*Acting Director of the United States Patent and Trademark Office*